United States Patent [19]

Ryan

[11] 4,341,488

[45] Jul. 27, 1982

[54] GUIDEPOST FOR PARKING VEHICLES

[75] Inventor: John E. Ryan, Irvine, Calif.

[73] Assignee: Autopost International, Inc., Reno, Nev.

[21] Appl. No.: 170,652

[22] Filed: Jul. 21, 1980

[51] Int. Cl.[3] ..... E01F 9/00

[52] U.S. Cl. ..... 404/10; 340/51; 40/608; 248/156

[58] Field of Search ..... 404/10; 40/608, 606; 248/156; 285/93; 340/114 R, 51, 61

[56] References Cited

U.S. PATENT DOCUMENTS

| | | | |
|---|---|---|---|
| 1,981,188 | 11/1934 | Pavitt | 116/28 R |
| 1,984,710 | 12/1934 | Thomas | 200/61.41 |
| 2,028,037 | 1/1936 | Babson | 200/61.41 X |
| 2,879,350 | 3/1959 | Howell | 340/51 X |
| 2,949,324 | 8/1960 | Birge et al. | 404/10 X |
| 3,193,817 | 7/1965 | Olewine | 340/331 X |
| 3,234,309 | 2/1966 | Graff | 264/137 X |
| 3,279,133 | 10/1966 | De Korte | 404/10 X |
| 3,737,731 | 6/1973 | Zeewy | 340/331 X |
| 4,253,415 | 3/1981 | Ferch | 340/114 X |
| 4,269,534 | 5/1981 | Ryan | 404/10 |

FOREIGN PATENT DOCUMENTS

| | | | |
|---|---|---|---|
| 7731495 | 5/1979 | France | 404/10 |
| 444423 | 6/1936 | United Kingdom | 340/114 |
| 1256639 | 12/1971 | United Kingdom | 340/114 R |
| 1318190 | 5/1973 | United Kingdom | 404/10 |
| 1324324 | 7/1973 | United Kingdom | 404/10 |

*Primary Examiner*—C. J. Husar
*Assistant Examiner*—Roberto L. Calderon
*Attorney, Agent, or Firm*—Francis X. LoJacono

[57] ABSTRACT

A guidepost device to be located and positioned in a garage, or other vehicle-parking area, which is arranged to be engaged by the vehicle being parked, the device including a support-base member having an elongated flexible rod secured to the support base at one end and an indicator mounted to the opposite free end of the rod, the indicator being positioned to indicate a reference point for the driver of the vehicle. The indicator can be provided by an illuminated sphere or by a flat reflector.

3 Claims, 10 Drawing Figures

GUIDEPOST FOR PARKING VEHICLES

BACKGROUND OF THE INVENTION

1. Field of the Invention

This invention relates generally to a visual-parking device for vehicles, and more particularly to a flexible guidepost having an illuminated indicator, whereby the driver can properly position his vehicle in a given area.

2. Description of the Prior Art

It is well known in the art that there is still a tremendous need for providing a suitable means to guide one in parking a vehicle in a given space or area, particularly in residential garages where very often space is extremely limited and the positioning of the vehicle while parking is critical. Because of the ever-increasing prices of automobiles and the costs of their related repairs, vehicle owners are becoming more conscious of the damage that can be inflicted on their vehicles while parking them in garages.

For example, one can damage the front end of his vehicle by making contact with a garage wall structure by not stopping in time. However, the rear end of a vehicle is prone to damage, if care is not taken to park an automobile sufficiently within the confines of the garage so that the garage door clears the vehicle when it is lowered to a closed position.

Another critical parking problem is created in residential garages having spaces for two or more vehicles. It is very desirable to establish specific parking boundaries to provide ample space between vehicles, so as to allow aisle spaces to the sides and to the rear for free access to and from the parked vehicles.

Various types of markers and mechanical parking guides can be found in the prior art. However, these devices have features that restrict their use, and they are very often too complicated in structure to be installed in the average residential garage. Some markers are limited as to location, particularly with respect to those devices that are designed to be affixed to wall structures and to be operated visually.

Other devices operate in such a manner that they provide an audio or sound indicator, and they are generally located in areas not visible to the vehicle driver. If a malfunction occurs in this type of operating device, great damage can come about—both to the vehicle and to the building structure.

SUMMARY OF THE INVENTION

The present invention has for an important object to provide a simple yet improved parking guide for vehicles that can be readily installed in either commercial or residential garages, and that does not require special tools for installation.

The improvement comprises a guidepost having a support base adapted to be bonded or otherwise suitably secured to a flat surface, preferably the floor of a garage. Affixed to the support base is an elongated rod formed of a fiberglass material, so as to be flexible for bending when engaged by the bumper of a parking vehicle.

The upper free end of the rod is provided with an indicator having various suitable illuminating means. One embodiment of the indicator includes a sphere having a light therein controlled by a switch that is activated by the movement of the rod. Another embodiment is a reflector that changes the angle of reflection as the rod flexes. In order to aid in the movement of the indicators, one arrangement of the rod will include a spring device interposed along the rod member.

Thus, it is an object of the present invention to provide a parking-guide device wherein the elongated rod of the device can be secured above the vehicle so as to be in full view of the driver.

It is a further object of the invention to provide a parking guide of this character that includes the minimum of operating parts, whereby the device is easily maintained, is relatively inexpensive to manufacture—and yet is durable in construction.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
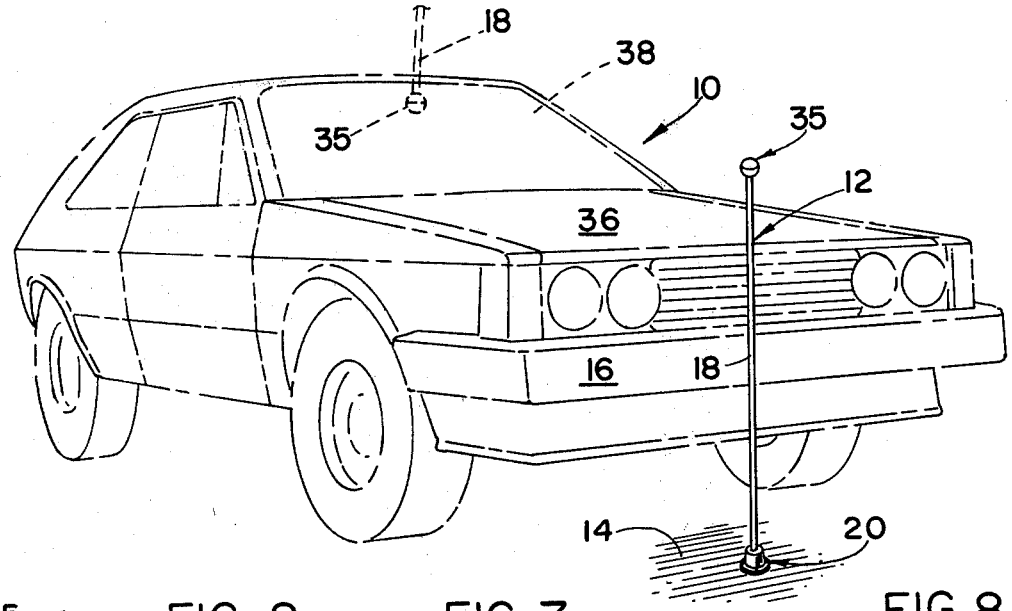
FIG. 1 is a pictorial view showing the parking guidepost being engaged by a vehicle, wherein the indicator is illustrated as being readily viewable by the driver thereof.
Figure 2:
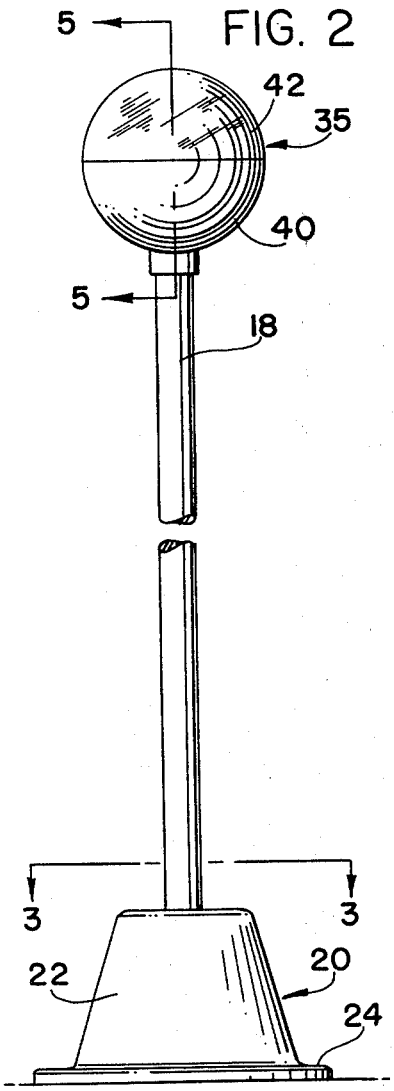
FIG. 2 is an elevational view of the first embodiment having a spherical indicator mounted to the free end of the rod.

Referring more particularly to FIG. 1, there is shown a typical vehicle 10 positioned in a proper parked position relative to the parking guidepost, generally indicated at 12. The arrangement and positioning of guidepost 12 will depend upon the given parking area; but preferably it will be mounted to floor 14 of the parking area, whereby the guidepost should be fixed so that a vehicle, such as at 10, can be centrally aligned therewith and allow the front bumper 16 of the vehicle to make contact with the elongated flexible rod 18 of the guidepost.

Accordingly, the parking guidepost 12 includes a support base member 20 which is defined by a truncated body 22 having an annular flange 24. Body 22 is formed having a central bore 26 in which one end of rod 18 is secured; and it further includes a plurality of recesses 28 which allow for a bonding material 30 to be received therein for better securing of the guidepost to a surface such as floor 14.

However, apertures 32 are provided about flange 24 to allow the guide to be affixed by screws to part of the garage structure, such as the wood framing, if one desires to position or suspend guide 12 from above the vehicle.

When the guidepost 12 is mounted as shown in FIG. 1, rod 18 is of such a length that the indicating means 35 is positioned above the hood 36 of the vehicle within easy view of the driver. If the guidepost is suspended above the vehicle as illustrated in FIG. 1, indicator 35 will be positioned to engage the central portion of front window 38 of vehicle 10.

Figure 5:
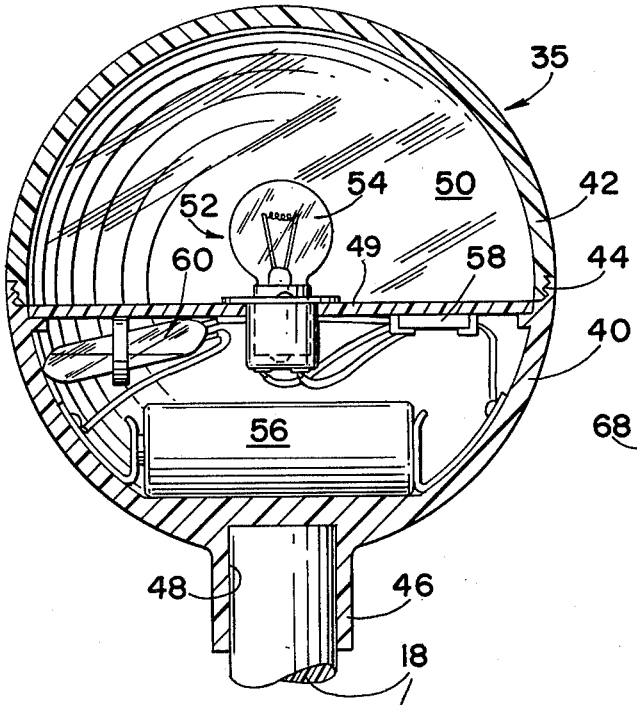
FIG. 5 is an enlarged cross-sectional view taken substantially along line 5—5 of FIG. 2, showing the illuminating means enclosed within the spherical indicator.
Figure 6:
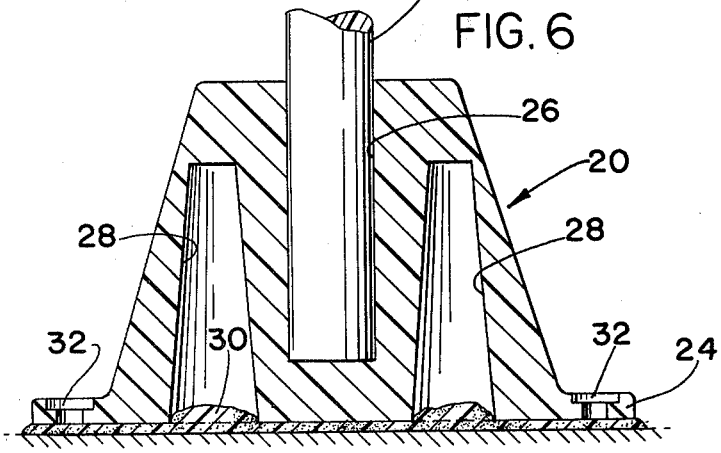
FIG. 6 is an enlarged cross-sectional view of the base member taken substantially along line 6—6 of FIG. 3.

In the embodiment of the device in FIGS. 1 through 8, it is contemplated that the indicator 35 will be comprised of a housing defined by a spherical body having a lower member 40 and an upper transparent member 42 adapted to be removably secured to the lower member 40, as seen in FIG. 5. As an example, the two members 40 and 42 are attached by threaded portions 44. Lower member 40 is provided with a hub 46 having a bore 48 to receive the free end of rod 18 therein.

Positioned within the compartment 50 defined by the attached members 49 and 42 is an illuminating means 52 which comprises a light 54 (an LED is also contemplated) that is included in a battery-operated circuit having a battery 56 and a suitable electronic chip 58 to create a flashing effect in light 54. A switch means 60 is provided, being of the type that activates the circuit when movement is applied to rod 18, or when rod 18 is angularly disposed as it is engaged by a vehicle. A suitable switch of this type is illustrated as a mercury switch. Further, it is contemplated that rod 18 be preferably formed from a fiberglass material that can be readily bent in any angular position, in order to allow switch 60 to be activated. Thus, when light 54 is illuminated, the driver, will back up and allow the light to be turned off—at which time the vehicle is in the correct location within a given parking space.

Figure 7:
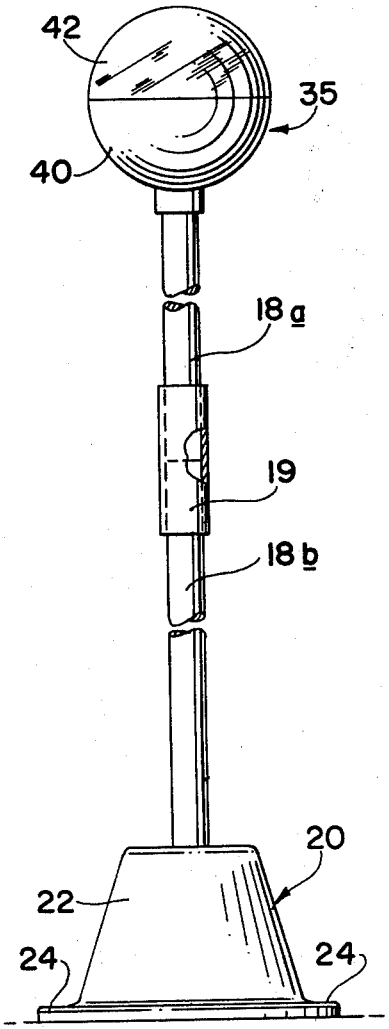
FIG. 7 is a side-elevational view of the guidepost, wherein the rod thereof is formed in two parts connected by a coupling member.

In FIG. 7, there is shown an alternative arrangement of rod 18, in which rod 18 is formed in two sections 18*a* and 18*b* connected by coupling member 19.

Figure 8:
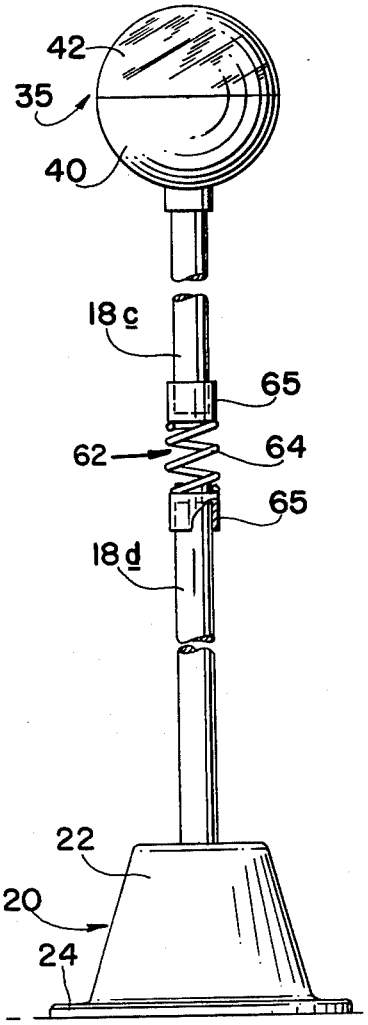
FIG. 8 is a side-elevational view of the guidepost, wherein the rod includes a spring member interposed between the indicator and the base member, to provide freer movement of the indicator.
Figure 3:
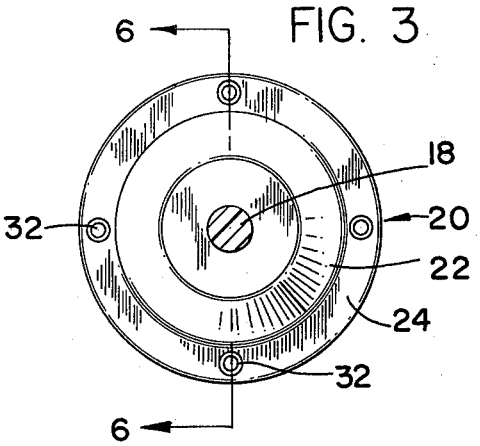
FIG. 3 is a cross-sectional view taken along line 3—3 of FIG. 2.
Figure 4:
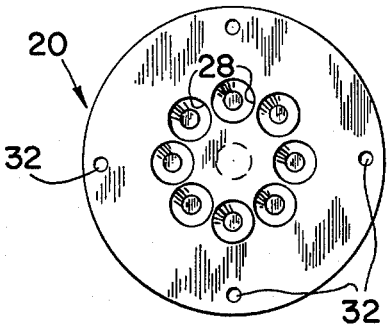
FIG. 4 is a bottom-plan view of the base member.

Referring to FIG. 8, there is illustrated another embodiment, wherein rod 18 includes a flexible means 62 comprising a spring member 64 having end cup members 65 adapted to receive the ends of each rod section 18*c* and 18*d*. Flexible means 62 should be located in the upper half of the rod, preferably just below indicator 35. Thus, when a vehicle engages the rod, the indicator will vibrate—causing switch 60 to intermittently open and close, and causing a flashing reaction in light 54. Hence, when flexible means 62 is employed, chip 58 of the circuit would not be required.

Figure 9:
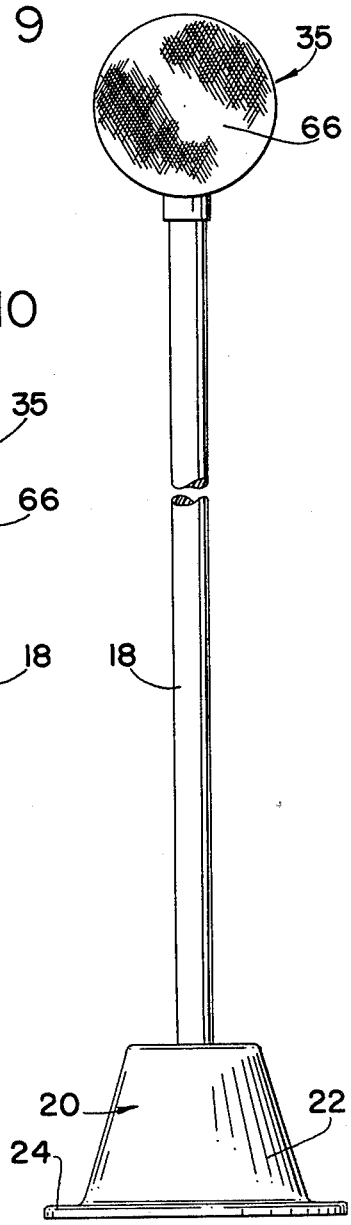
FIG. 9 is a front-elevational view of the guidepost device having a reflector as an indicator.
Figure 10:
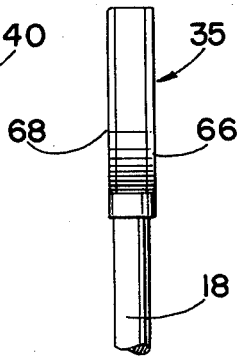
FIG. 10 is a side-elevational view of the reflector thereof.

FIGS. 9 and 10 further present an indicator 35 having front and rear reflector surfaces 66 and 68, respectively. Thus, with any movement of rod 18, light reflected from either side will flicker and be readily seen by the vehicle driver.

It also should be noted that the lower and upper members 40 and 42, respectively, can be provided with separate color arrangements—such as, for example, red for the upper member and white for the lower member. When two different colors are provided, a horizontal division therebetween is readily noticeable. It has been found that such a division creates a visual reaction when the indicator is even slightly moved. Thus, the driver of a vehicle can readily establish any movement of the guidepost.

The invention and its attendant advantages will be understood from the foregoing description; and it will be apparent that various changes may be made in the form, construction and arrangement of the parts of the invention without departing from the spirit and scope thereof, or sacrificing its material advantages, the arrangement hereinbefore described being merely by way of example; and I do not wish to be restricted to the specific form shown or uses mentioned, except as defined in the accompanying claims.

I claim:

1. An improved vehicle-parking guidepost to be positioned in a given vehicle-parking area to aid the driver thereof in correctly positioning a vehicle in said given area, said parking guidepost comprising:

a support base having a central bore therein;

an elongated flexible rod member having one end thereof mounted in said central bore of said support base, and an opposite free end;

an illuminatable housing defining a sphere having an upper transparent body member and a lower body member, said upper body member being removably secured to said lower body member;

a light bulb mounted in said housing wherein the upper transparent member is illuminated thereby;

a battery connected to said light bulb;

a switch means adapted to be activated when said guidepost is angularly tilted from a vertical position by said vehicle to illuminate said light bulb, and wherein said battery and said switch means are contiguously disposed in said illuminatable housing.

2. An improved vehicle-parking guidepost as recited in claim 1, wherein said upper and lower body members are each provided with a different color by which a horizontal division is defined therebetween.

3. An improved vehicle-parking guidepost as recited in claim 1, including an intermittent activating means which comprises an electronic chip adapted to provide intermittent flow of power from said battery to said light bulb, said electronic chip being located in said lower body member.

* * * * *